United States Patent [19]

Everett

[11] 4,129,196

[45] Dec. 12, 1978

[54] FLUID ACOUSTIC SILENCER

[76] Inventor: Wilhelm S. Everett, 3098 Solimar Beach, Ventura, Calif. 93001

[21] Appl. No.: 837,812

[22] Filed: Sep. 29, 1977

[51] Int. Cl.[2] ..... F01N 1/12

[52] U.S. Cl. ..... 181/280; 181/269

[58] Field of Search ..... 181/230, 229, 247, 255, 181/279, 280, 281, 268, 272, 274, 269

[56] References Cited

U.S. PATENT DOCUMENTS

| | | | |
|---|---|---|---|
| 1,468,398 | 9/1923 | Reed | 181/212 |
| 3,841,841 | 10/1974 | Torosian et al. | 181/238 |
| 4,050,539 | 9/1977 | Kashiwara et al. | 181/280 |

*Primary Examiner*—L. T. Hix
*Assistant Examiner*—Benjamin R. Fuller
*Attorney, Agent, or Firm*—Ralph B. Pastoriza

[57] ABSTRACT

The acoustic silencer functions as a pulsation dampener to minimize noise generated in liquid and/or gaseous fluids inherently present in fluid conveying systems which embody pumps, compressors, engines and the like. The device includes a shell divided into first and second compartments by a partition supporting a central tube placing the compartments in communication with each other. The tube passage itself is provided with internal diametrically oppositely positioned vanes forming an acute angle with the axis of the tube to impart a rotational component to fluid flow through the tube. A polar or rotational inertence is thus provided in addition to linear inertence to the fluid flow thereby enabling shorter tubes to be utilized with a subsequent simplication in the manufacture and an increased reliability in the structural integrity of the silencer.

7 Claims, 6 Drawing Figures

FLUID ACOUSTIC SILENCER

This invention relates to acoustic silencers sometimes referred to as acoustic filters or pulsation dampeners for minimizing noise inherent in fluid conveying lines connected to pumps, compressors, reciprocating engines and the like.

BACKGROUND OF THE INVENTION

Acoustic silencers or pulsation dampeners have been known for many years. The most common type comprises a shell defining a volume divided in the middle with a tube connecting the two compartments. The smaller the tube in diameter and the longer its length, the more impedance, or in acoustical terms, the more inertence is developed. Also, the smaller the tube and the longer it is, the higher the friction losses. Some of the earlier pulsation dampeners in order to have long tubes without restricting the flow too much, install a hairpin design so that the tube is longer than the vessel or shell, and the tubes are doubled back on each end.

Other methods for developing acceptable reduction in noise were to belmouth the ends of the tubes and install a venturi diffuser on the exit ends so that the pressure drop is minimized, allowing higher velocity, smaller tubes and therefore a higher inertence.

Other prior art devices include structures such as shown in my U.S. Pat. No. 2,993,559 which employs three chambers interconnected by various tubes in such a manner as to effect in addition to attenuation, phase cancellation of acoustic waves.

In all of these prior art designs, it is normally desirable that the tube within the shell be relatively small in diameter and long in length. The tubes are thus "limber" as compared to short fatter tubes and normally require intermediate supports fastening the tube within the shell of the acoustic filter. Where the acoustic noise to be dampened includes low frequency components as result, for example, from reciprocating compressors, the low frequency pulsations tend to dilate the shell resulting in failure of the tube supports either at the shell or at the tube. The long tube design is desirable in order to introduce a proper amount of linear inertence, but as a consequence, as noted, such design has made prior art silencers and dampeners expensive to manufacture and of questionable reliability after prolonged use.

BRIEF DESCRIPTION OF THE PRESENT INVENTION

With the foregoing considerations in mind, the present invention contemplates an improved fluid acoustic silencer design wherein effective pulsation dampening can be achieved without requiring the long thin type tubes characterizing prior art structures. As a consequence, the manufacture of the devices is greatly simplified and the reliability correspondingly increased.

In accord with the invention, vane means comprising first and second vanes in the form of flat plates having arcuate edges are introduced into a cylindrical tube and secured to diametrically opposite internal wall portions of the tube. The securement point of the edges extends in like axial directions and opposite circumferential directions to define segments of a spiral, the circumferential extent of each vane being no greater than 180° and the plane of each vane forming an acute angle with the axis of the tube. With this arrangement, the tube provides not only a linear inertence but also a polar inertence; that is, a rotational flow component is developed.

As a consequence of the foregoing construction, equivalent tubes can be shorter, bigger, stiffer and less subject to fatigue. Moreover, in the case of fluid gases with suspended liquid droplets and heavier specific gravity, separation and coagulation is readily achieved.

By controlling the angulation and area of the vanes, the rotational flow can be controlled so that a designer can adapt the tube sizes and the construction much more easily than if he can only employ linear inertence. In fact, with this variable feature at the design stage the acoustic silencer can be designed into a cylindrical vessel, or can be used as a cantilevered design into an existing volume to provide terminal or line impedance. This latter structure is often practical for pulsation dampeners already installed on reciprocating compressors. It is particularly useful on high speed vane pumps as used in aircraft hydraulic systems. Finally, because the fluid is rotated, reflected waves are minimized.

BRIEF DESCRIPTION OF THE DRAWINGS

A better understanding of this invention as well as further features and advantages thereof will be had by referring to the accompanying drawings in which.

DETAILED DESCRIPTION OF THE INVENTION

Figure 1:
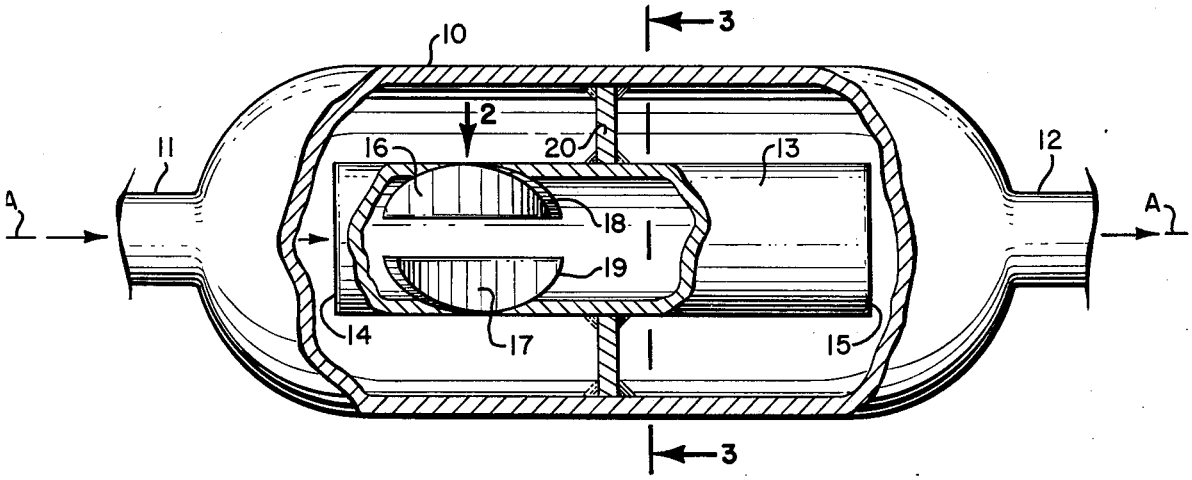
FIG. 1 is a cut-away perspective view of a preferred embodiment of the fluid acoustic silencer of this invention.

Referring first to FIG. 1, there is shown a preferred embodiment of the invention including an outer casing or shell 10 having inlet and outlet openings 11 and 12 for connection in a fluid line in which pulsations are to be damped. Within the casing 10 there is provided a passage means in the form of a cylindrical tube 13 having inlet and outlet ports 14 and 15.

In accord with the invention, there are provided first and second vanes 16 and 17 in the form of flat plates having arcuate edges 18 and 19 secured to diametrically opposite internal wall portions of the tube. As is evident from FIG. 1, these edges extend in like axial directions relative to the axis A—A of the tube and shell and opposite circumferential directions to define segments of the spiral. The circumferential extent of each vane is no greater than 180° and the plane of each vane forms an acute angle with the axis A—A of the tube of from 30°–45°.

The tube 13 itself is supported within the casing 10 by a central partition 20 dividing the casing into first and second chambers communicating with the inlet opening 11 and inlet port 14 for the left side chamber and the outlet opening 12 and outlet port 15 in the right side chamber.

Figure 2:
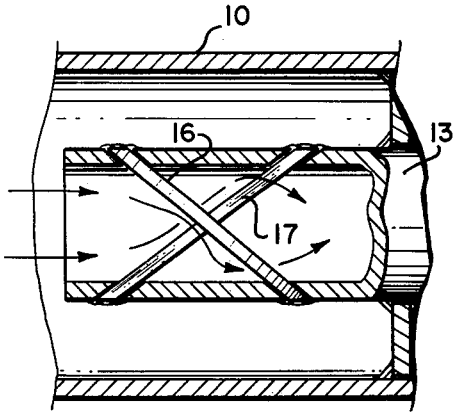
FIG. 2 is a fragmentary view partly in cross section looking in the direction of the arrow 2 of FIG. 1.

With particular reference to the top fragmentary view of FIG. 2, fluid flow passing into the inlet port of the tube 13 has a rotational component imparted to it by the vanes 16 and 17 thereby introducing a rotational inertence. In the preferred embodiment shown, the vanes are disclosed closer to the inlet port 14 than the outlet port 15 so that this rotational component extends down a major length of the passage defined by the tube 13.

Figure 3:
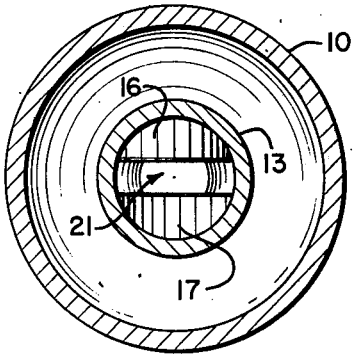
FIG. 3 is an end cross sectional view taken in the direction of the arrows 3—3 of FIG. 1.

With reference to FIG. 3, it will be noted that the opposed edges of the vanes can be spaced to provide a straight-through passage portion as indicated at 21. The amount of rotational inertence relative to the linear inertence can thus be controlled by the designer.

Figure 4:
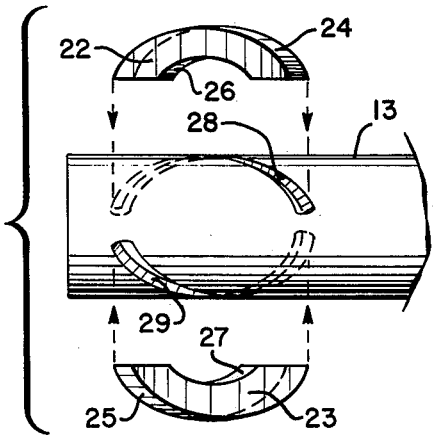
FIG. 4 is an exploded fragmentary perspective view of a modified form of the invention illustrating one manner of assembly.

FIG. 4 is illustrative of one manner of assemblying the vanes in the tube 13. In the example of FIG. 4, modified type vanes are illustrated at 22 and 23 having arcuate edges 24 and 25 and further including smaller arcuate cut-outs 26 and 27 on their opposed edges to provide for straight-through flow. Thus, rather than having the opposed edges of the vanes spaced as illustrated in FIG. 3, appropriate controlled cut-outs could be provided.

In FIG. 4, the tube 13 is provided with mitered slots 28 and 29 into which the vanes 22 and 23 may be inserted, the arcuate edges then simply being welded all around the slot outlines.

As described earlier, the imparting of a rotational component of the fluid flow permits shorter and fatter tubes to be utilized than possible in the prior art without sacrifice of surge dampening or silencing efficiency. Moreover, the basic tube construction with the vanes is adaptable to many different types of pulsation dampeners.

Figure 5:
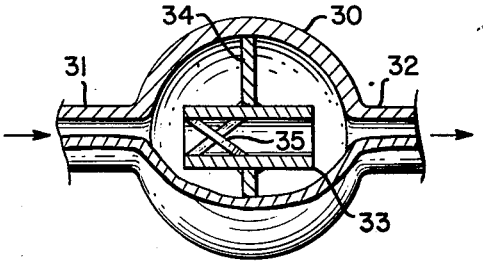
FIG. 5 is a cut-away view of a further application of the present invention; and, FIG. 6 is a cut-away view of yet another embodiment of the invention.

As an example, reference is had to FIG. 5 illustrating a spherical type outer shell or casing 30 having diametrically opposite inlet and outlet openings 31 and 32 and incorporating a short tube 33 in axial alignment with the inlet and outlet openings. Tube 33 is supported by a dividing partition 34 to provide left and right chambers within the spherical casing 30. Appropriate vanes are illustrated at 35 in the tube 33 to provide the desired rotational inertence to fluid flow.

Figure 6:
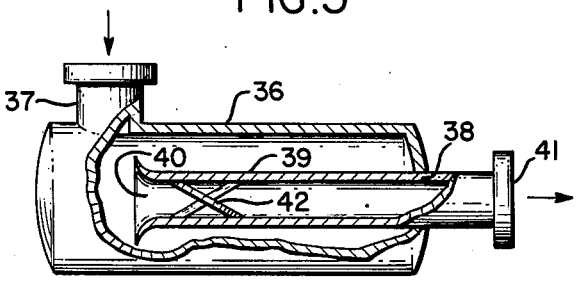

FIG. 6 illustrates yet another application wherein there is provided a casing or shell 36 having an inlet opening 37 and outlet opening 38 wherein a central tube 39 has a major portion of its length disposed within the casing 36. The tube 39 in this case has a bell-shaped inlet port 40, the inlet opening 37 being at right angles to the axis of the tube. The outlet portion of the tube 39 is exteriorally sealed to the outlet opening 38 of the casing 36, the actual outlet port itself being indicated at 41 exterior of the casing. Vanes 42 are provided in the tube 39 similar to the vanes 16 and 17 described in FIG. 1 and disposed closer to the inlet port 40 than the outlet port.

The cantilevered design illustrated in FIG. 6 is particularly useful on high speed vane pumps such as used in aircraft hydraulic systems.

The design illustrated in FIG. 6 can also be employed for the entrance nozzle 37 and in fact can be used for both the entrance and exit. This arrangement is particularly useful for reciprocating compressors where large passageways within the cylinder provide a volume which needs to be dampened prior to vessel formed by casing 36.

From all of the foregoing, it will be evident that the present invention has provided an improvement in acoustic silencers or pulsation dampeners wherein equivalent efficiency in noise abatement can be achieved without requiring the long, thin tubes and associated supports heretofore required. Thus, the primary advantage of the present invention is the ease of construction, installation and design without sacrifice of efficiency. The introduction of a rotational inertence by the vanes not only allows this simpler and more reliable design but has the added advantage as also heretofore mentioned of minimizing reflected waves.

I claim:

1. A fluid acoustic silencer, including, in combination:

(a) a cylindrical tube having an inlet port for receiving fluid and an outlet port from which said fluid passes; and (b) vane means secured within said passage means closer to said inlet port than said outlet port for imparting a rotational component to fluid flow through said passage means, said vane means consisting solely of first and second vanes in the form of flat plates having arcuate edges secured to diametrically opposite internal wall portions of said tube, the securement point of said edges extending in like axial directions and opposite circumferential directions to define segments of a spiral, the circumferential extent of each vane edge being no greater than 180° and the plane of each vane forming an acute angle with the axis of said tube, the remaining portion of said tube beyond said plates to said outlet port being free of all obstructions so that the rotational component imparted to said fluid is free to adjust to the flow conditions and whereby a shorter and fatter cylindrical tube than heretofore required for equivalent acoustic silencing results.

2. The subject matter of claim 1, in which said acute angle ranges from 30° to 45°, and in which said circumferential extent is less than 180° to leave a space between said vanes defining a straight through passage portion for said fluid.

3. A fluid acoustic silencer including, in combination:

(a) an outer casing having inlet and outlet openings;

(b) a cylindrical tube having an inlet port and an outlet port, at least a major portion of said tube including its inlet port being supported within said casing; and (c) vane means consisting solely of first and second vanes in the form of flat plates having arcuate edges secured to diametrically opposite internal wall portions of said tube, said edges extending in like axial directions and opposite circumferential directions to define segments of a spiral, the circumferential extent of each vane being no greater than 180° and the plane of each vane forming an acute angle with the axis of said tube of from 30° to 45°, the remaining portion of said tube beyond said plates to said outlet port being free of all obstructions whereby fluid passing into the inlet opening of said casing also passes through said inlet port and out said outlet port, said first and second vanes imparting a rotational component to the fluid flow through said tube.

4. The subject matter of claim 3, in which the edge of each vane opposite its arcuate edge includes a cut-out to leave a clear space between the vanes defining a straight through passage portion for said fluid flow.

5. The subject matter of claim 3, in which said tube is positioned wholly within said casing with its inlet and outlet ports adjacent to and in coaxial alignment with said inlet and outlet openings; and a partition internally dividing said casing into first and second chambers, said tube passing through and being supported by said partition, said inlet opening and inlet port communicating with said first chamber and said outlet opening and outlet port communicating with said second chamber, said first and second vanes being disposed closer to said inlet port than to said outlet port.

6. The subject matter of claim 5, in which said outer casing is in the form of a sphere, said inlet and outlet openings being on diametrically opposite points of said sphere.

7. The subject matter of claim 3, in which an outlet end portion of said tube passes through said outlet opening of said casing in sealing relationship therewith, the inlet opening to said casing receiving fluid flow in a direction at right angles to the axis of said tube, said inlet opening being adjacent to the inlet port of said tube.

* * * * *